US008368304B2

(12) United States Patent
Baacke et al.

(10) Patent No.: US 8,368,304 B2
(45) Date of Patent: Feb. 5, 2013

(54) DISCHARGE LAMP

(75) Inventors: Swen-Uwe Baacke, Neuburg/Donau (DE); Bernhard Ruhland, Dollnstein (DE); Wolfgang Seitz, Eichstaett (DE); Christian Wider, Ingolstadt (DE)

(73) Assignee: OSRAM AG, Munich (DE)

( * ) Notice: Subject to any disclaimer, the term of this patent is extended or adjusted under 35 U.S.C. 154(b) by 0 days.

(21) Appl. No.: 13/266,474

(22) PCT Filed: Mar. 18, 2010

(86) PCT No.: PCT/EP2010/053557

§ 371 (c)(1), (2), (4) Date: Oct. 27, 2011

(87) PCT Pub. No.: WO2010/124904

PCT Pub. Date: Nov. 4, 2010

(65) Prior Publication Data

US 2012/0049731 A1 Mar. 1, 2012

(30) Foreign Application Priority Data

Apr. 30, 2009 (DE) ..... 10 2009 019 526

(51) Int. Cl.
*H01J 61/36* (2006.01)

(52) U.S. Cl. ..... 313/623; 313/570; 313/625; 313/332

(58) Field of Classification Search ..... None
See application file for complete search history.

(56) References Cited

U.S. PATENT DOCUMENTS

| | | | | |
|---|---|---|---|---|
| 2,682,009 | A | 6/1954 | Fraser | |
| 3,219,870 | A | 11/1965 | Gottschalk | |
| 3,636,395 | A | 1/1972 | Banes, Jr. et al. | |
| 3,660,711 | A | 5/1972 | Stanyon et al. | |
| 5,140,222 | A | 8/1992 | Roznerski | |
| 5,369,329 | A | 11/1994 | Austad et al. | |
| 5,793,160 | A | 8/1998 | Losco | |
| 5,859,492 | A | 1/1999 | Austad et al. | |
| 6,137,228 | A | 10/2000 | Aizawa et al. | |
| 6,741,035 | B2 * | 5/2004 | Matsushima et al. | 313/623 |
| 6,954,032 | B2 * | 10/2005 | Chiba | 313/623 |
| 7,253,562 | B2 | 8/2007 | Gräf et al. | |

(Continued)

FOREIGN PATENT DOCUMENTS

| | | | |
|---|---|---|---|
| DE | 7009862 | U | 6/1970 |
| DE | 4030820 | A1 | 4/1992 |

(Continued)

*Primary Examiner* — Ashok Patel

(57) ABSTRACT

In various embodiments, a discharge lamp may include a lamp vessel that includes a discharge vessel enclosing a discharge medium and two lamp shafts each extending coaxially at opposite ends of the discharge vessel, two outer power-feed sections each extending to the outside from one of the lamp shafts, two electrodes each consisting of an electrode rod and electrode head, with the electrode rods being arranged along the lamp shafts such that the two electrode heads are located mutually opposite inside the discharge vessel, a sealed section in each of the two lamp shafts by which a gas-tight electricity passage is formed between the two outer power-feed sections on the one hand and the two electrodes on the other, a narrow section in each of the two lamp shafts that is arranged between the respective sealed section and the electrode head of the associated electrode, with the narrow section closely surrounding the electrode rod, and a damping/guiding element arranged between the narrow section of a lamp shaft and the electrode rod of at least one electrode.

14 Claims, 4 Drawing Sheets

U.S. PATENT DOCUMENTS

| | | | |
|---|---|---|---|
| 2008/0203920 | A1 | 8/2008 | Wang et al. |
| 2009/0243486 | A1 | 10/2009 | Albrecht |
| 2009/0261728 | A1 | 10/2009 | Albrecht et al. |

FOREIGN PATENT DOCUMENTS

| | | | |
|---|---|---|---|
| DE | 19812298 | A1 | 10/1998 |
| DE | 10305339 | A1 | 8/2003 |
| DE | 10353861 | A1 | 6/2004 |
| DE | 10325553 | A1 | 12/2004 |
| DE | 102005046483 | A1 | 3/2007 |
| EP | 1047111 | B1 | 10/2000 |
| JP | 5994355 | A | 5/1984 |
| JP | 5283049 | A | 10/1993 |
| WO | 2008006759 | A2 | 1/2008 |

* cited by examiner

DISCHARGE LAMP

RELATED APPLICATIONS

The present application is a national stage entry according to 35 U.S.C. §371 of PCT application No.: PCT/EP2010/053557 on Mar. 18, 2010, which claims priority from German application No.: 10 2009 019 526.2 filed on Apr. 30, 2009.

TECHNICAL FIELD

The invention proceeds from a discharge lamp. Lamps of such kind are employed in, for example, photo-optic applications such as projection systems, exposing semiconductors to light, and curing with UV radiation etc., but also for lighting in general and stage and architectural lighting etc.

BACKGROUND

Lamps of such kind have a discharge vessel filled with a discharge medium, for example an inert gas—with or without added mercury and possibly other fill additives. Arranged mutually opposite inside the discharge vessel are two electrodes each supported by a lamp shaft arranged coaxially relative to the respective electrode. Also provided in the lamp shaft is a gas-tight electricity passage for the electric connection between external power terminals and the electrodes. That sealed section of the lamp shaft can be produced using, for example, transition glasses (being then known as a graded seal). Other lamp-sealing technologies, for example foil sealing or foil pinching, are however also employed for lamps of such kind.

Particularly in the case of high-power lamps in, say, the kilowatt or multi-kilowatt range, arranging the electrodes such as to be permanently gas-tight is challenging owing to their increasing mass. Even while lamps of such kind are being transported, vibrations due to shock impacts can occur on the electrode rods supporting the massive electrode heads and may cause damage to the lamp shaft resulting in premature seal or lamp breakage. That problem will be further exacerbated on the anode-side lamp shaft of a lamp provided for direct current (DC) because the anode has to be implemented as particularly massive. Added to this is the fact that the electrode rods needed for the massive electrode heads are subjected to a relatively high stress owing to the change in temperature during the startup phase or when the lamp has been switched off. That complicates centering and guiding the electrode rods because mechanical transmission of forces and/or stresses onto the lamp shafts has to be prevented. Stress breaks could otherwise occur.

Document WO 2008/006759 discloses a short-arc discharge lamp in which the electrode rods are centered and/or guided with the aid of a narrow section in the lamp shafts. The narrow section surrounds the electrode rod closely but not tightly. Any vibrations in the electrode rod occurring when the lamp is shaken, for example during transportation, may consequently be transmitted to the narrow section and cause damage (natural resonance). Varying temperature-related expansion which the electrode rod undergoes can furthermore result in rubbing in the narrow section against the inner wall of the lamp shaft and in said shaft's being damaged as a result.

SUMMARY

Various embodiments provide a short-arc discharge lamp having an improved arrangement of the electrodes. Further embodiments improve shock and vibration resistance in the region of the lamp shafts.

A first embodiment includes a short-arc discharge lamp having a lamp vessel that includes a discharge vessel enclosing a discharge medium and two lamp shafts each extending coaxially at opposite ends of the discharge vessel, two outer power-feed sections each extending to the outside from one of the lamp shafts, two electrodes each consisting of an electrode rod and electrode head, with the electrode rods being arranged along the lamp shafts such that the two electrode heads are located mutually opposite inside the discharge vessel, a sealed section in each of the two lamp shafts by which a gas-tight electricity passage is formed between the two outer power-feed sections on the one hand and the two electrodes on the other, and a narrow section in each of the two lamp shafts that is arranged between the respective sealed section and the electrode head of the associated electrode, with the narrow section closely surrounding the electrode rod, characterized in that a damping/guiding element is arranged between a lamp shaft's narrow section and at least one electrode's electrode rod.

Additional embodiments can be found in the dependent claims and in the accompanying disclosure.

Investigations undertaken by the inventors have shown that a short-arc discharge lamp's shock and vibration resistance can be significantly increased with the aid of a damping/guiding element around the electrode rod in the region of a lamp shaft's narrow section.

Damping of the electrode rod during a shock impact with consequent increased breaking strength of the lamp shaft will on the one hand be achieved by means of the damping/guiding element. Said damping is due inter alia to the shape and material characteristics of the element as well as its suitably dimensioned axial extent. The objective pursued therein is to distribute what in the prior art when the lamp is shaken is a narrowly limited local shock impact of the electrode rod over a larger area in order thereby to prevent or at least significantly reduce damage to the lamp-shaft wall. The damping/guiding element ought therefore to surround the electrode rod along an adequate length, preferably the entire length of the narrow section. The element is furthermore preferably rotationally symmetric. That will ensure that the electrode rod can be well guided even when its length changes significantly as the temperature changes, for example during the lamp's startup cycle, relative to the lamp-shaft material, usually quartz glass. The relative movements then occurring between the electrode rod and lamp-shaft wall will consequently no longer cause the electrode rod to rub against the lamp-shaft wall and possibly damage its surface, resulting in premature breaking of the lamp shaft. The electrode rod will instead be guided by the damping/guiding element, meaning the electrode rod and lamp-shaft wall will no longer make direct contact in the narrow section.

The damping/guiding element is first arranged on the electrode rod and put into its intended position. The electrode rod is then inserted along with the damping/guiding element into the lamp shaft and the narrow section embodied. Because the lamp-shaft material must for that purpose be heated to its softening temperature, in particular metals having a sufficiently high melting point, meaning tungsten or molybdenum, for instance, are suitable for the damping/guiding element.

The damping/guiding element is embodied preferably as a wire helix that is wound onto the electrode rod or otherwise applied, for example pre-wound and plugged, at least along a part of the narrow section. A spacing is furthermore provided preferably at least between two adjacent turns of the wire helix. When the lamp shaft is being narrowed, some of its material can as a result penetrate between the turns and axial securing of the wire helix can be achieved thereby. That will prevent the wire helix from slipping out of position on the electrode rod and from being co-displaced with the electrode rod as it undergoes temperature-related expansion, which would in turn cause undesired rubbing against the lamp-shaft wall and consequent damage thereto.

A foil that surrounds the electrode rod like a cuff along at least a part of the narrow section has alternatively also proved its worth as a damping/guiding element. The foil is for that purpose either wrapped around the electrode rod or prefabricated—for example in the manner of a cuff—and pushed over the electrode rod. The foil preferably has an embossing consisting of for instance, knobbles or suchlike that is raised toward or against (as shown in FIG. 5) the lamp-shaft wall surrounding the foil. What is achieved thereby is that while the lamp shaft is being narrowed the raised embossing will be able to penetrate the lamp-shaft-wall material that is heated up and softened during that production phase and thereby produce axial securing comparable to what the wire helix provides. To improve the damping effect it can be advantageous to provide supplementary raised parts on the side facing the electrode rod.

BRIEF DESCRIPTION OF THE DRAWINGS

In the drawings, like reference characters generally refer to the same parts throughout different views. The drawings are not necessarily to scale, emphasis instead being generally upon illustrating the principles of the invention. in the following description, various embodiments are described with reference to the following drawings, in which.

DETAILED DESCRIPTION

Figure 1:
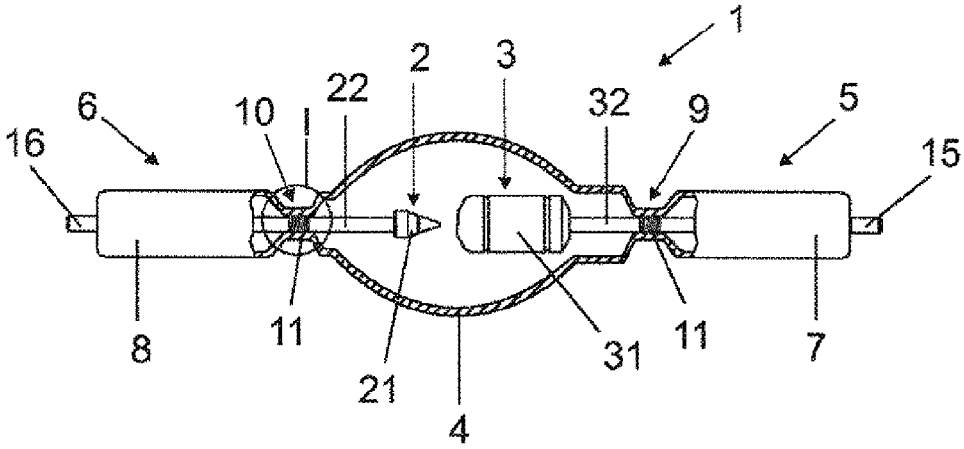
FIG. 1 is a partially sectioned longitudinal view of an inventive short-arc discharge lamp for DC operation.

The following detailed description refers to the accompanying drawings that show, by way of illustration, specific details and embodiments in which the invention may be practiced.

Features that are the same or of the same kind have been assigned the same reference numerals in the following.

Figure 2:
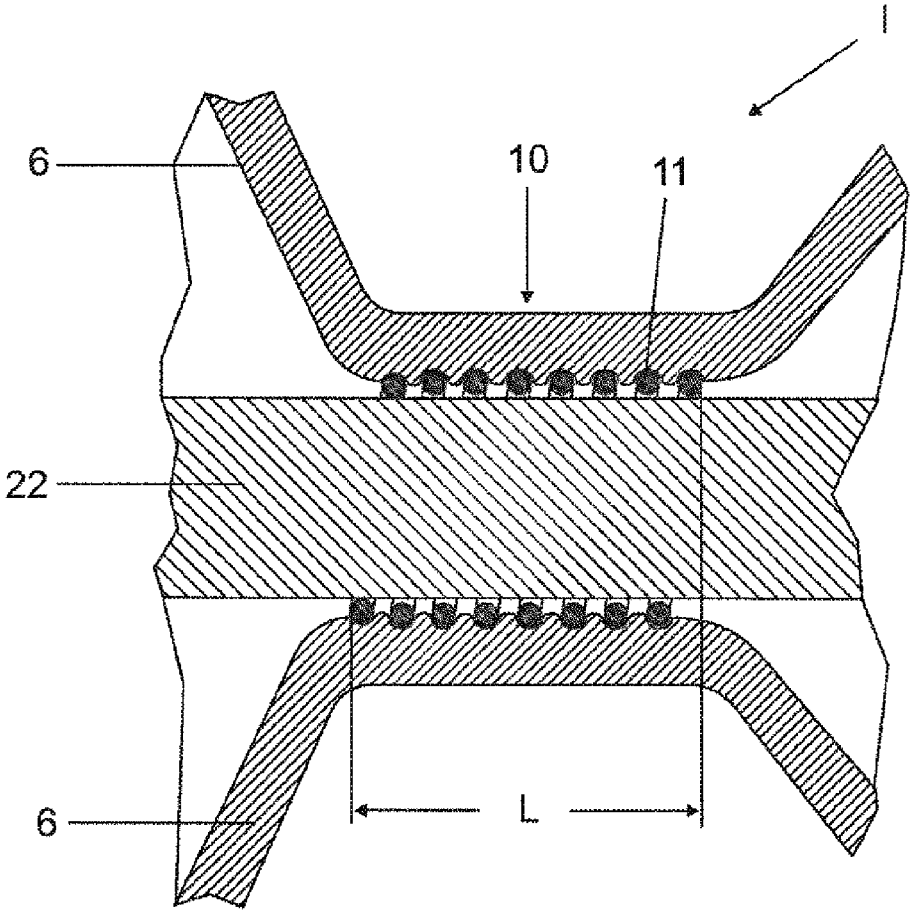
FIG. 2 is a longitudinal section through an enlarged part I of the narrow section of the lamp shown in FIG. 1.

FIG. 1 is a schematic of a first exemplary embodiment of an inventive short-arc discharge lamp 1 that is provided for projection purposes and has a wattage of 4,000 W. It is an inert-gas short-arc discharge lamp filled with xenon. Lamp 1 is provided for DC operation and has for that purpose a cathode 2 and anode 3. Said two electrodes 2, 3 are arranged mutually opposite approximately 7 mm apart in a quartz-glass, substantially ellipsoidal discharge vessel 4 and thus define a longitudinal lamp axis A. Cathode 2 and anode 3 each have an electrode head 21 and 31 respectively and an electrode rod 22 and 32 respectively. The head and rod are in this case separate parts that have been plugged together but can also be fabricated as a single piece. Electrode rods 22, 32 each extend into a substantially circular-cylindrical oblong lamp shaft 5, 6. Lamp shafts 5, 6 are arranged coaxially on either of the two ends of discharge vessel 4 and are furnished on their respective end with a cap sleeve 7, 8. Both lamp shafts 5, 6 have under cap sleeves 7, 8 a sealed section (not apparent in this representation) embodied here as a graded seal produced using transition glasses. Provided in each case between the sealed section and electrode head 21, 31 is a narrow section 9, 10 where the lamp shaft's glass closely surrounds the respective electrode rod in order to keep both electrodes 2, 3 coaxially oriented even when lamp 1 is in the horizontal position. Reference will also be made in the following to FIG. 2 showing the region I of narrow section 10 in enlarged form. A tungsten wire helix 11 functioning as a damping/guiding element is arranged on electrode rod 22 in said region. The turns of wire helix 11 therefore spiral between the surface of electrode rod 22 and the inner surface of lamp shaft 6 closely surrounding said region. Wire helix 11 has a wire diameter of 0.6 mm, a helical pitch of 1.6 mm, and a length L of 24 mm. The first turn of wire helix 11 has an internal diameter of 5.35 mm; the internal diameter of the rest is 5.7 mm. Helical wire 11 is during assembly turned onto electrode rod 22 whose outside diameter is 5.5 mm. The first, narrower turn will provide a secure hold on the electrode rod during that lamp-production phase. Wire helix 11 is moreover oriented such that the first, narrower turn will be located preferably on the end facing away from the electrode head. The rest of the wire helix in the front region will as a result be able to better damp any impacts that occur. Electrode rod 22 along with wire helix 11 is thereafter inserted into lamp shaft 6 and narrow section 10 is then embodied by heating lamp shaft 6 in said region followed by a roll-in operation during which a shaping roller is pressed onto the rotating lamp shaft. A little of the suitably hot and consequently viscous quartz glass will therein be squeezed between the individual turns of wire helix 11, as a result of which wire helix 11 will have been at least axially secured in position in said narrow section 10 of lamp shaft 6. The result will be axial guiding for electrode rod 22 in the event of thermal expansion while the lamp is operating. Rubbing of the electrode rod against the lamp-shaft wall as in the prior art will be prevented thereby. Damping of the electrode rod 22 when subjected to an impact load will be provided by the approximately 14 turns, which will distribute any possibly occurring impact over the entire helix and thereby largely prevent local damage to the lamp shaft. The situation in anode-side lamp shaft 5 located opposite is analogous. The above-described effects and advantages of the invention are even especially prominent here owing to the anode head's greater mass. Projecting from the end of each lamp shaft 5, 6 is an outer power-feed section 15, 16 which in the case of the graded seal employed is formed by the ends of electrode rods 22, 32.

Impact tests have shown that the relevant lamps' breaking strength can be increased with the aid of the aforementioned tungsten helix from typically up to approximately 40 g (g=gravitational acceleration or gravitational-field strength) to between approximately 50 and 60 g. The latter corresponds to an approximate height of fall for the lamp in its transportation packaging of 260 to 320 cm compared with typically 160 to 200 cm hitherto.

The wall thickness in the narrow section of the lamp shafts was in both cases approximately 3.8 mm.

Figure 3:
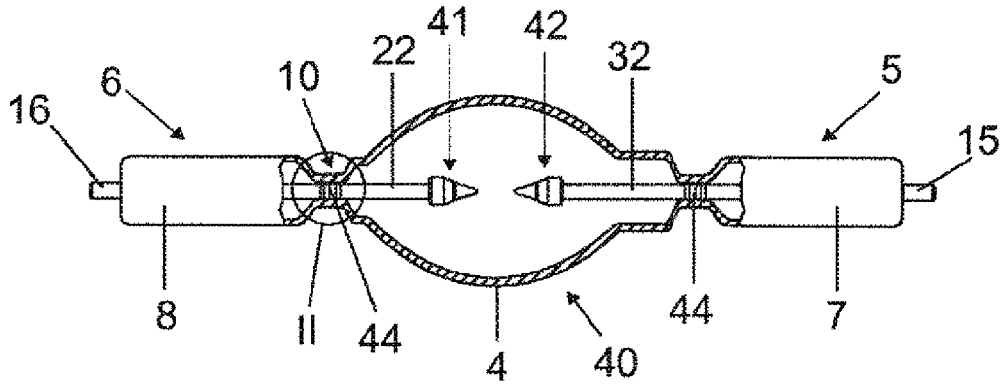
FIG. 3 is a partially sectioned longitudinal view of an inventive short-arc discharge lamp for AC operation.
Figure 4:
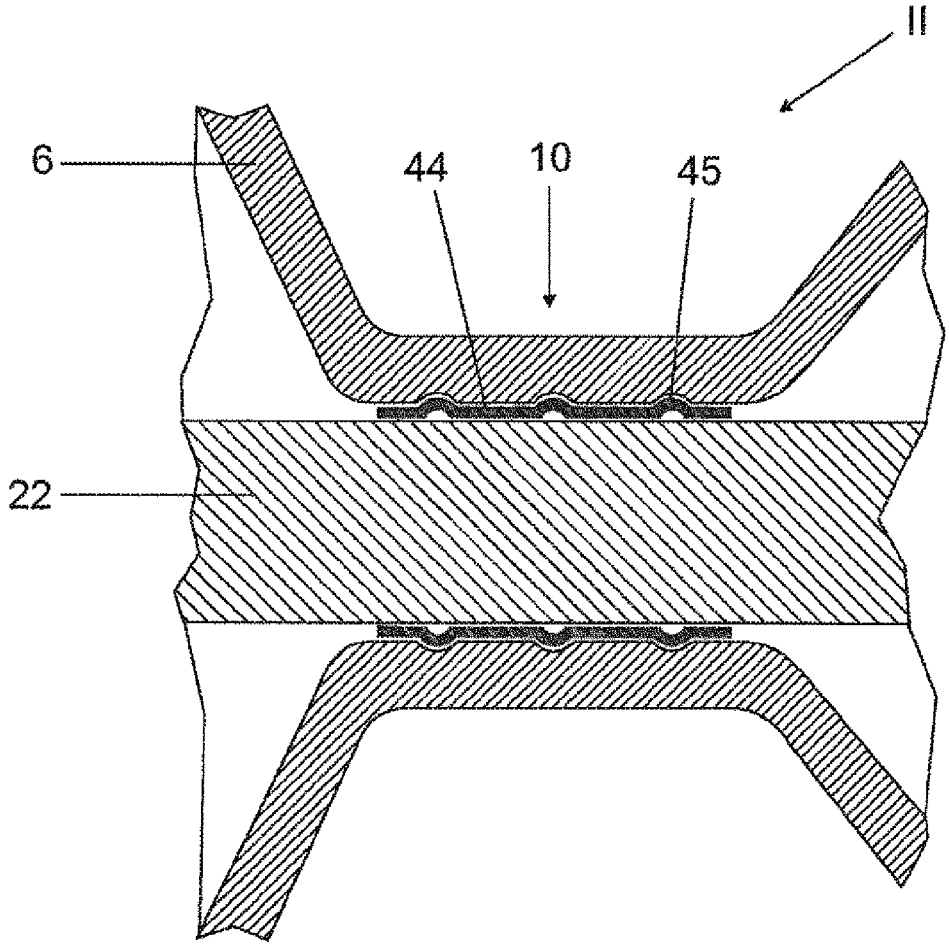
FIG. 4 is a longitudinal section through an enlarged part II of the alternative embodiment of the narrow section of the lamp shown in FIG. 3.
Figure 5:
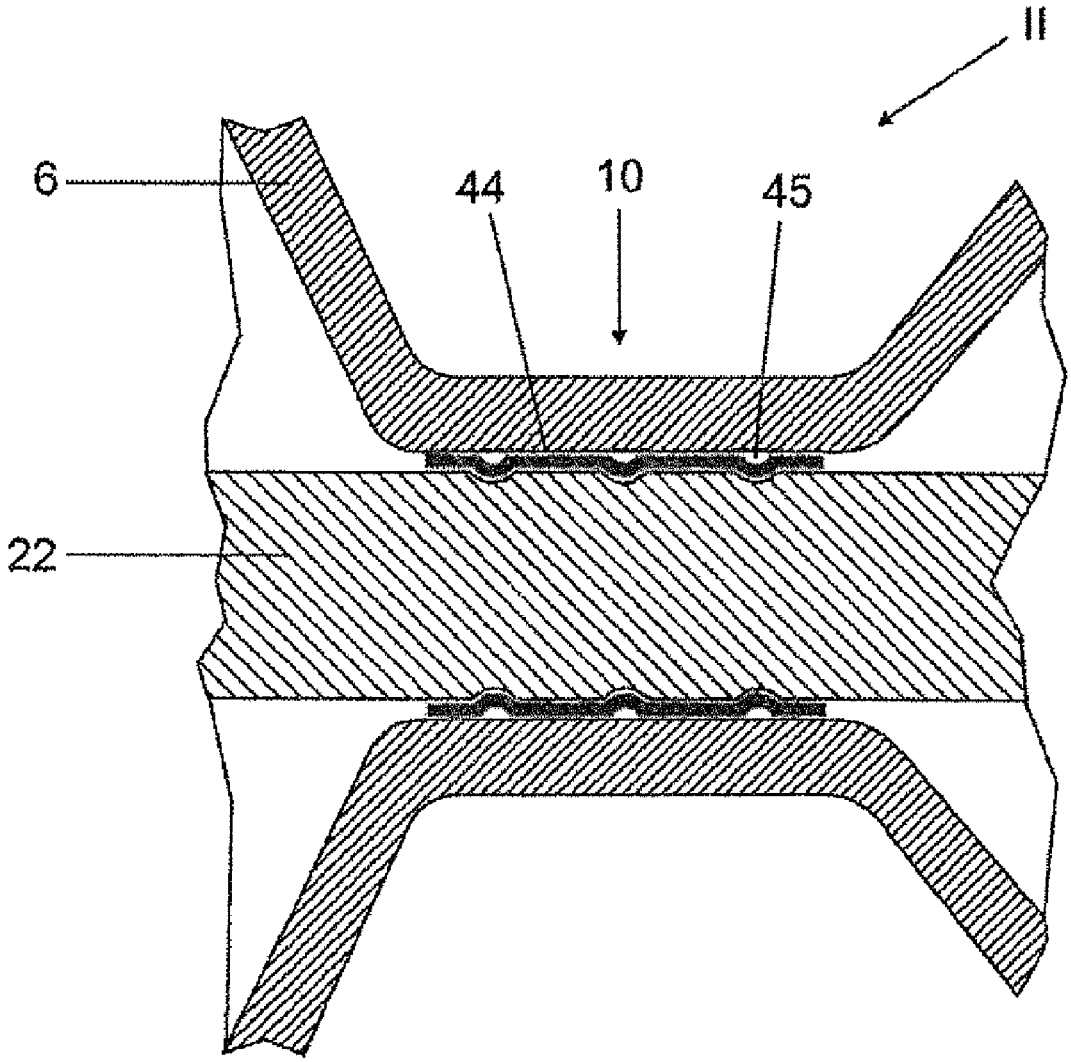
FIG. 5 is a longitudinal section through an enlarged part II of another alternative embodiment of the narrow section of the lamp shown in FIG. 3.

FIG. 3 is a schematic of another exemplary embodiment of an inventive short-arc discharge lamp 40 designed for AC operation. The two electrode heads 41, 42 are for that reason the same here. The lamp in FIG. 3 otherwise differs from that in FIG. 1 only in having an alternative embodiment of the damping/guiding element provided for the narrow section. In that connection, reference will also be made in the following to FIG. 4 which shows region II of narrow section 10 in enlarged form. The relevant element is a molybdenum foil 44 shaped into a cuff. Embossed into foil 44 are knobbles 45 that are raised toward the surrounding wall of lamp shaft 6. Cuff is first pushed over electrode rod 22, then everything together into lamp shaft 6. While narrow section 10 is being produced by a roll-in operation, the heated quartz glass of lamp shaft 6 will be soft in that region so that knobbles 45 can slightly sink into the shaft wall. Securing in the axial direction will be achieved thereby that is similar to the previous instance with the wire helix (FIGS. 1 and 2). Knobbles 45 will also damp electrode rod 22 in the event of shock impacts. The damping effect can be further reinforced if knobbles projecting additionally toward the electrode rod are embossed (not shown).

A breaking strength of 70 g (direction of impact perpendicular to the longitudinal lamp axis), corresponding to an approximate height of fall of 380 cm, was determined during a break test on a short-arc discharge lamp having a knobble-embossed molybdenum foil in the narrow section. The wall thickness in the narrow section of the lamp shafts was in that instance approximately 3.7 mm.

Figure 6:
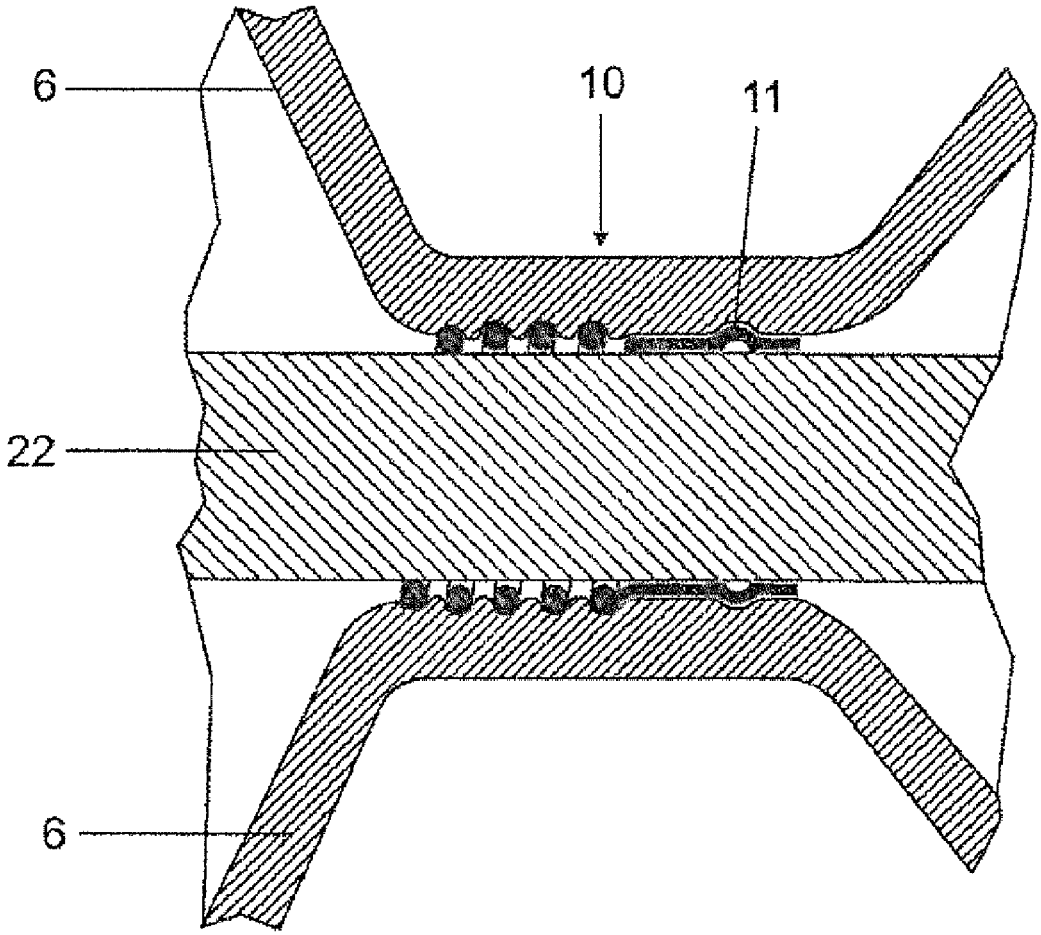
FIG. 6 is a longitudinal section through an enlarged part of the narrow section of the lamp.

It may in certain circumstances be possible to achieve a further improvement using a combination of resilient wire helix and foil in the narrow section as for example shown in FIG.6.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A discharge lamp comprising:

a lamp vessel that includes a discharge vessel, the lamp vessel enclosing a discharge medium and including two lamp shafts each extending coaxially at opposite ends of the discharge vessel, two outer power-feed sections, each extending outwardly from inside the two lamp shafts respectively, two electrodes, each consisting of an electrode rod and electrode head, with the electrode rods being arranged along the lamp shafts such that the two electrode heads are located radially opposite one another inside the discharge vessel, a sealed section in each of the two lamp shafts by which a gas-tight electricity passage is formed between the two outer power-feed sections on the one hand and the two electrodes on the other, a narrow section in each of the two lamp shafts that is arranged between the respective sealed section and the electrode head of the associated electrode, with the narrow section closely surrounding the electrode rod; and a damping/guiding element arranged between the narrow section of a lamp shaft and the electrode rod of at least one electrode, wherein the damping/guiding element is embodied as at least hybrid bearing wire helix arranged on the electrode rod within a part of the narrow section, wherein the hybrid bearing wire helix comprises a securing winding located on the end of the narrow section farthest from the electrode head and a plurality of damping windings.

2. The discharge lamp as claimed in claim 1, wherein the sealed section is formed by foil sealing or foil pinching.

3. The discharge lamp as claimed in claim 1, wherein a mutual spacing is provided at least between two adjacent turns of the wire helix.

4. The discharge lamp as claimed in claim 1, wherein the outer power-feed sections are formed by the ends of the electrode rods.

5. The discharge lamp as claimed in claim 1, wherein the damping/guiding element is made of metal.

6. The discharge lamp is claimed in claim 5, wherein the metal is at least one of tungsten or molybdenum.

7. The discharge lamp as claimed in claim 1, wherein the damping/guiding element extends along the entire length of the narrow section.

8. The discharge lamp as claimed in claim 1, wherein the damping/guiding element is embodied as a combination of the wire helix and a foil.

9. The discharge lamp as claimed in claim 8, wherein the foil surrounds the electrode rod along at least a part of the narrow section.

10. The discharge lamp as claimed in claim 9, wherein the foil is embossed.

11. The discharge lamp as claimed in claim 10, wherein the embossing is raised toward the shaft wall surrounding the foil.

12. The discharge lamp as claimed in claim 11, wherein the embossing is raised toward the electrode rod.

13. The discharge lamp as claimed in claim 10, wherein the embossing is raised toward the electrode rod.

14. The discharge lamp as claimed in claim 10, wherein the embossing is knobbles.

* * * * *